US008820250B2

(12) United States Patent
Craig et al.

(10) Patent No.: US 8,820,250 B2
(45) Date of Patent: Sep. 2, 2014

(54) FURNACE CHUTE

(75) Inventors: Ian Mervyn Craig, Stockton-on-Tees (GB); Jeremy Fletcher, Stockton-on-Tees (GB); Gareth Kaps, Darlington (GB); Neil Millington, Stockton-on-Tees (GB)

(73) Assignee: Siemens Vai Metals Technologies Ltd., South Yorkshire (GB)

( * ) Notice: Subject to any disclaimer, the term of this patent is extended or adjusted under 35 U.S.C. 154(b) by 569 days.

(21) Appl. No.: 12/954,370

(22) Filed: Nov. 24, 2010

(65) Prior Publication Data

US 2011/0132242 A1 Jun. 9, 2011

(30) Foreign Application Priority Data

Dec. 4, 2009 (GB) ..... 0921247.3

(51) Int. Cl.

| | |
|---|---|
| ***F23K 3/00*** | (2006.01) |
| ***F27D 3/10*** | (2006.01) |
| ***C21B 7/20*** | (2006.01) |
| ***F27B 1/20*** | (2006.01) |

(52) U.S. Cl.

CPC ... *F27D 3/10* (2013.01); *C21B 7/20* (2013.01); *F27B 1/20* (2013.01)

USPC ..... 110/267; 110/275; 110/277; 110/287

(58) Field of Classification Search

CPC ..... F27D 3/10; C21B 7/20; F27B 1/20

USPC ..... 110/101 R, 267, 275, 277, 287; 266/176–184; 414/198

See application file for complete search history.

(56) References Cited

U.S. PATENT DOCUMENTS

| | | | | |
|---|---|---|---|---|
| 2,802,661 | A | 8/1957 | McCutcheon | |
| 4,029,220 | A * | 6/1977 | Greaves | 414/206 |
| 4,225,277 | A * | 9/1980 | Martin | 414/198 |
| 4,547,116 | A * | 10/1985 | Legille et al. | 414/160 |
| 7,311,486 | B2 * | 12/2007 | Gorza et al. | 414/301 |
| 8,419,336 | B2 * | 4/2013 | Fletcher et al. | 414/207 |
| 2002/0043221 | A1 | 4/2002 | Hytonen et al. | 122/428 |

FOREIGN PATENT DOCUMENTS

| | | | | |
|---|---|---|---|---|
| CS | 227413 | | 6/1984 | F27D 3/10 |
| EP | 1662009 | A1 | 5/2006 | C21B 7/20 |
| JP | 54046805 | | 4/1979 | B32B 21/14 |
| JP | 03-122206 | A * | 5/1991 | C21B 7/18 |

(Continued)

OTHER PUBLICATIONS

U.K. Search Report, U.K. patent application No. GB0921247.3, 4 pages, Mar. 17, 2010.

(Continued)

*Primary Examiner* — Kenneth Rinehart
*Assistant Examiner* — Gajanan M Prabhu
(74) *Attorney, Agent, or Firm* — King & Spalding L.L.P.

(57) ABSTRACT

A moving distribution furnace chute for use with a furnace has a tube (3) for distribution of material, the tube having a longitudinal axis, an open inlet end (8) and an open outlet end (9). The tube further has a plurality of vanes (14) mounted on an inner surface of the tube, the vanes having a length extending in a direction having a component along the axis (15) and a breadth extending in a direction having a component radially inwards towards the axis.

27 Claims, 3 Drawing Sheets

(56) References Cited

FOREIGN PATENT DOCUMENTS

| | | | |
|---|---|---|---|
| JP | 3122206 A | 5/1991 | ..... C21B 7/18 |
| SU | 1199801 A | 9/1983 | ..... C21B 7/20 |
| WO | 98/38465 | 9/1998 | ..... F27B 1/20 |

OTHER PUBLICATIONS

Chinese Office Action, Application No. 201010579147.2, 14 pages, Nov. 25, 2013.

* cited by examiner

FURNACE CHUTE

CROSS-REFERENCE TO RELATED APPLICATIONS

This application claims priority to GB Patent Application No. 0921247.3 filed Dec. 4, 2009. The contents of which is incorporated herein by reference in its entirety.

TECHNICAL FIELD

This invention relates to a furnace chute for loading material into a furnace in particular for a moving distribution chute for solid material.

BACKGROUND

Conventionally, distribution of solid or liquid material into a furnace has been by means of a fixed delivery mechanism, such as a liquid spray tube, or into a bell top furnace, where material falls onto the bell and drops in a curtain around the circumference of the bell. With these fixed delivery arrangements, in some cases deflector plates, or ribs are added to the fixed delivery mechanisms to even out the distribution of the material. In SU1199807, fixed ribs are provided to encourage rotation in the bell to prevent wear of the bell where material falls onto it.

A furnace for metal production requires careful loading of charging material which by its nature is abrasive and erosive. In another example a conical distribution chute is supported by rings in a gimbal arrangement, producing independent and combined tilting of the chute axis. This enables an even loading of the charging material. It is desirable that moving distribution chute produces linear material flow, results in homogeneously mixed material and enhances wear properties to extend the serviceable life of the chute.

SUMMARY

According to an embodiment, a moving distribution furnace chute for use with a furnace, may comprise a tube for distribution of material, the tube having a longitudinal axis, an open inlet end and an open outlet end, wherein the tube further comprises a plurality of vanes mounted on an inner surface of the tube, the vanes having a length extending in a direction having a component along the axis and a breadth extending in a direction having a component radially inwards towards the axis.

According to a further embodiment, the length of at least some of the vanes can be substantially parallel to the axis of the chute. According to a further embodiment, the breadth of at least some of the vanes may extend radially inwards to the axis of the chute. According to a further embodiment, at least some of the vanes may extend along a full axial length of the chute. According to a further embodiment, the vanes may be shorter than the full axial length of the chute. According to a further embodiment, at least one of the vanes can be arranged at an angle to the axis of the chute. According to a further embodiment, at least one vane can be formed into a spiral in the chute. According to a further embodiment, the vanes can be moveable or can be fixed.

According to another embodiment, a furnace assembly may comprise a furnace and a furnace chute as described above.

BRIEF DESCRIPTION OF THE DRAWINGS

Specific embodiments will now be described, by way of example only, with reference to the accompanying drawings in which.

DETAILED DESCRIPTION

In accordance with a first aspect, there is provided a moving distribution furnace chute for use with a furnace, the chute comprising a tube for distribution of material, the tube having a longitudinal axis, an open inlet end and an open outlet end, wherein the tube further comprises a plurality of vanes mounted on an inner surface of the tube, the vanes having a length extending in a direction having a component along the axis and a breadth extending in a direction having a component radially inwards towards the axis.

The various embodiments provide a means to control the flow path of the material through a gimballed chute to achieve the desired flow path, improve directional flow and promote mixing.

By providing a plurality of vanes, the desired flow of material from the inlet to the outlet end and hence into the furnace may be arranged. For example, the flow may be arranged to ensure that the entire chute inner surface bears charging material into the furnace which spread the effect of the induced wear over a greater extent of the chute than is possible in prior art arrangements. This prolongs the serviceable life of the chute. Alternatively, or additionally, the flow path may be arranged to ensure a certain mix state for the materials.

Preferably, the length of at least some of the vanes can be substantially parallel to the axis of the chute.

Preferably, the breadth of at least some of the vanes may extend radially inwards to the axis of the chute.

Preferably, at least some of the vanes may extend along a full axial length of the chute.

Preferably, the vanes can be shorter than the full axial length of the chute.

Preferably, at least one of the vanes can be arranged at an angle to the axis of the chute.

Preferably, at least one vane can be formed into a spiral in the chute.

In one embodiment, the vanes are moveable. Alternatively, the vanes are fixed.

The vanes may be fixed or moveable. The vanes counteract problems resulting from the tipping motion of the chute itself, counteract rotation of the chute and generate more linear flow. Use of movable vanes allows the flow path, or mixing state to be adapted to the conditions or to the material being used. Where the vanes are made moveable actuators may be included to move the vanes to the required positions. For example, the actuators may move the angle of the vanes relative to an axis of the chute. The actuators may be hydraulically or electrically operable and a controller may be provided to do this in an adaptive manner.

In accordance with a second aspect, a furnace assembly comprises a furnace and a furnace chute according to the first aspect.

Figure 1:
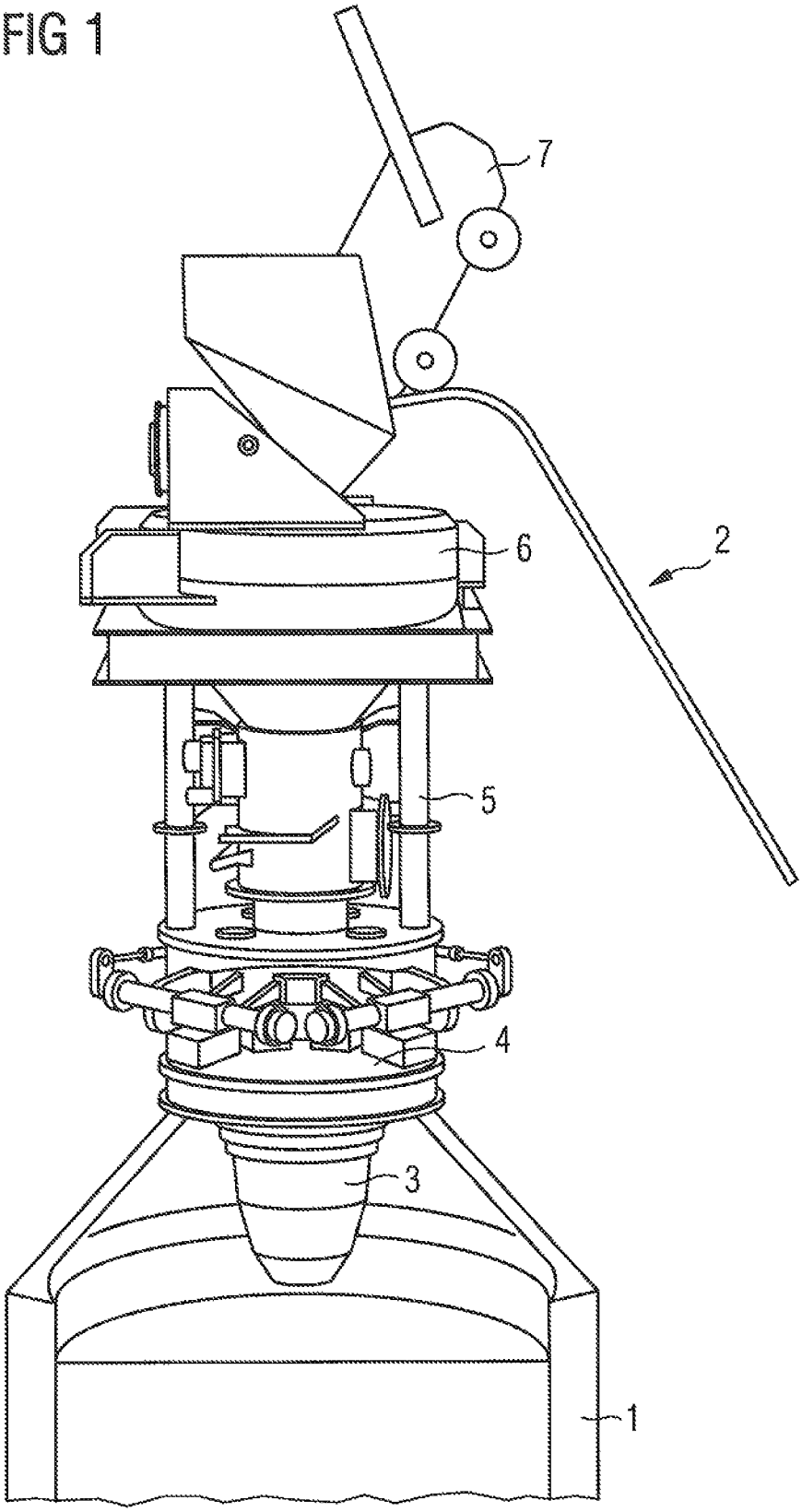
FIG. 1 shows an over view of furnace with a chute in accordance with various embodiments.

The various embodiments provide a modified design of a conical distribution chute with a gamble arrangement, to generate an improvement in the linearity of the material flow through the chute. As is shown in FIG. 1, a furnace 1 has located at its upper end a distributor arrangement 2 which comprises a distributor tilting chute 3 rotatably mounted by a gimbal top distributor 4 to a flow gate assembly 5. The chute is rotated about an axis of the furnace and tiltable relative to that axis by movement of the gimbal top distributor 4. A holding hopper 6 is provided at the upper end of the flow gate 5 into which may be tipped from a skip 7, ore and other materials to be loaded into the furnace 1. When the flow gate 5 is opened the material falls down into the chute 3 (as it rotates and tilts) to direct it into the furnace 1. The apparatus thus far described will be well known to persons skilled in the art of furnace design and therefore need not be described further.

The chute 3, however, is provided with a novel structure. As is shown in partial cutaway in FIG. 2, the chute 3 is configured as a tube with an inlet end 8 and an outlet end 9. The chute is fixed to the gimbal top distributor at the inlet end 8. The tube may be a one-piece conical tube, as shown in FIG. 3, or may be made up of a number of segments of varying diameter. In one example, illustrated in FIG. 2, the tube has a first portion 11 of relatively constant diameter, a second portion 12 of a diameter which reduces in the axial direction and a third portion 13 which reduces in diameter in the axial direction at greater rate than the second portion. This provides an outlet end 9 which is of a smaller diameter than the inlet 8.

Figure 2:
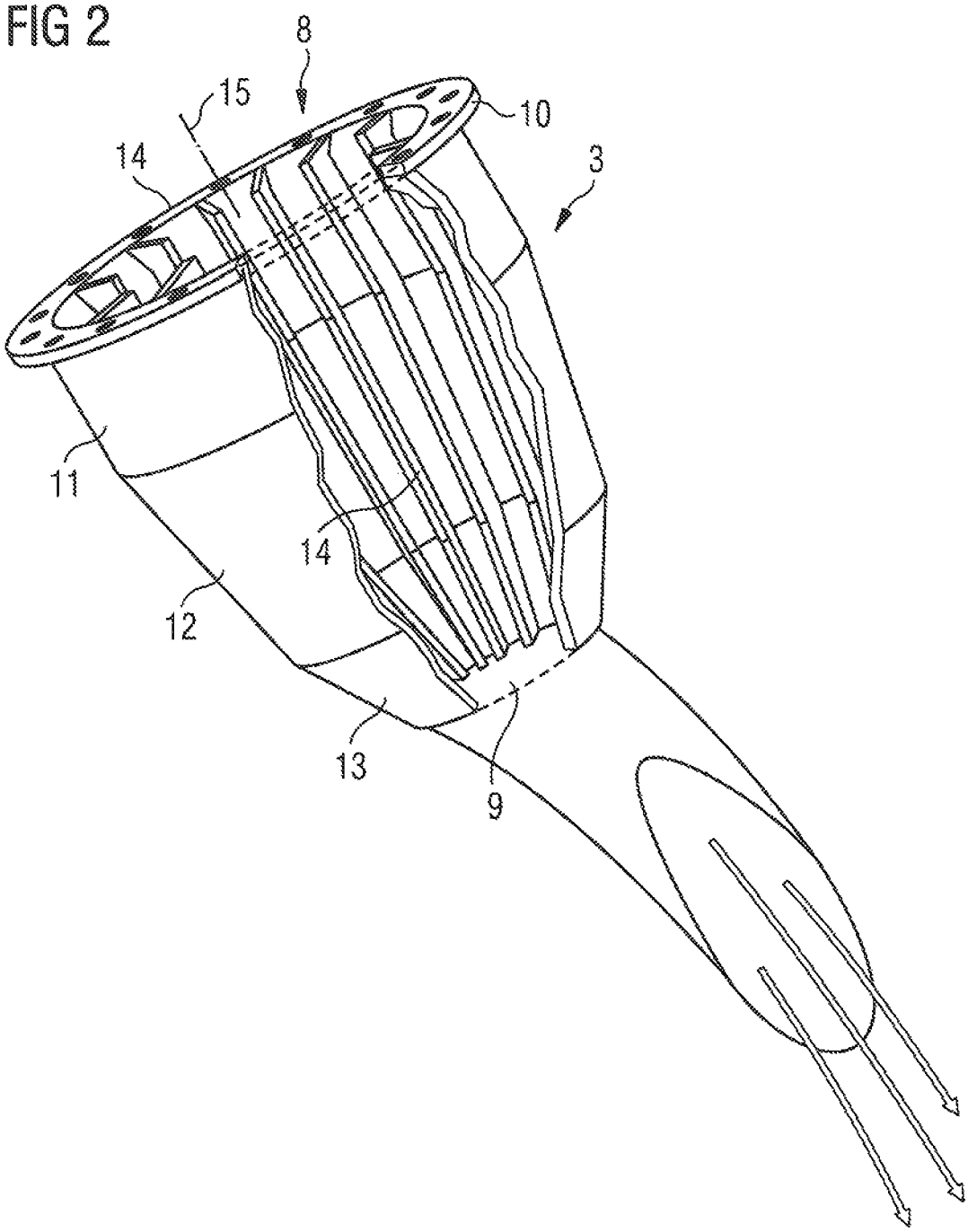
FIG. 2 shows a perspective view of the chute shown in FIG. 1 with part of the wall removed to show the vane structure.

The inner surface of the chute 3 includes a plurality of vanes 14. These are fabricated from a wear resistant material, such as steel sheet welded to the inner surface of the chute to be parallel to the axis 15 of the chute. Alternatively, other wear resistant materials, such as ceramics may be used. For ease of assembly the vanes may be fabricated in three sections to match the inner diameter changes of the portions 11, 12 and 13. The vanes extend breadthwise radially inwards towards the axis 15. The breadth reduces over their length towards the outlet end 9. In the example of FIG. 2, the vanes on the inner surface extend along the full axial length of the chute.

The arrangement of vanes provides for a linear flow of the material as it falls through the chute ensuring even wear patterns to the chute. It will be appreciated that whilst in the described embodiment the vanes are substantially parallel to the chute axis some variation to this may be possible providing it does not affect the linear flow substantially. Though in one described embodiment, the vanes are described as substantially radial, it will be appreciated that this may be varied. The vanes themselves are depicted as nominally identical. Some variation may be possible by for example having vanes of different breadth. It may also be possible to have vanes which do not extend for the full chute length as depicted. They may be made shorter such that they terminate at an inner position away from the outlet end 9, or away from the inlet end 8.

Figure 3A:
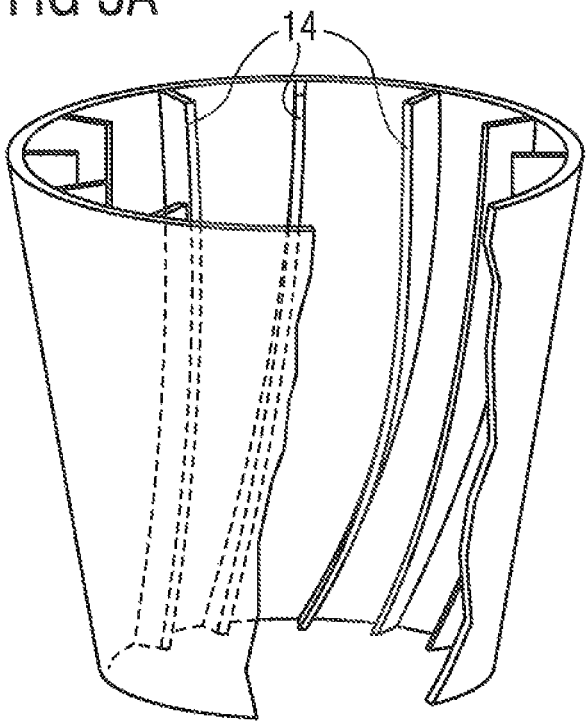
FIGS. 3A and 3B show alternative vane arrangements.
Figure 3B:
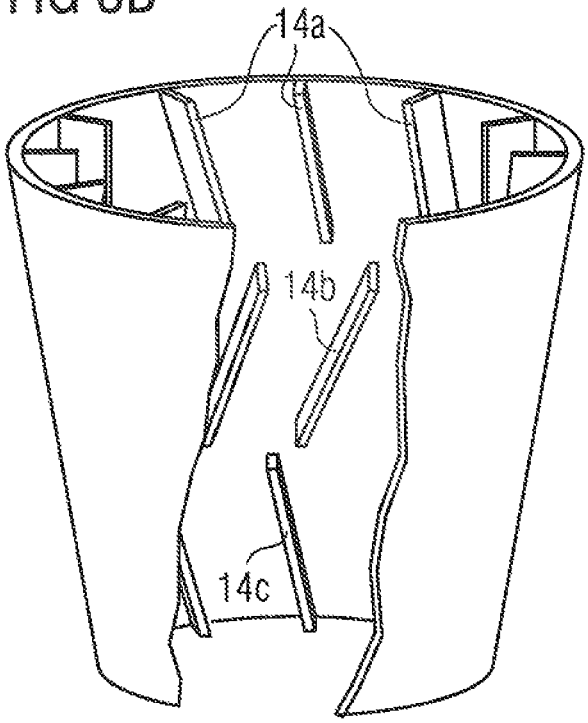

FIG. 3 shows some alternative vanes arrangements. These also encourage an even flow about the inner periphery of the chute. In FIG. 3*a* the vanes extend for the length of the chute but are arranged in a spiral fashion. In FIG. 3*b*, multiple, shorter vanes 14*a*, 14*b* and 14*c*, with each length of vane arranged to be at an angle to the axis of the chute. The vanes are arranged in an alternating fashion in the different portions, 11, 12, 13 of the chute, or longitudinally vary in the example of a single cylindrical chute.

The vanes illustrated in the described embodiment are fixed in place. However, in alternative embodiments they may be made moveable. For example, in the FIG. 3*b* embodiment actuators may be added to allow the angles of the vanes relative to the axis to be varied, either on set-up or in use

What is claimed is:

1. A moving distribution furnace chute for use with a furnace, the chute comprising:

a tube for distribution of material, the tube having a longitudinal axis, an open inlet end and an open outlet end downstream of the open inlet end, wherein the tube further comprises a plurality of vanes mounted on an inner surface of the tube, the vanes having a length extending in a direction having a component along the axis and a breadth extending in a direction having a component radially inwards towards the axis, wherein the open inlet end has a larger diameter than the open outlet end, and wherein the tube comprises three segments having different degrees of taper with respect to the longitudinal axis, the three segments comprising, in order along the longitudinal axis: a first segment, a second segment downstream of the first segment and having a greater degree of taper than the first segment, and a third segment downstream of the second segment having a greater degree of taper than the second segment.

2. The moving distribution furnace chute according to claim 1, wherein the length of at least some of the vanes is substantially parallel to the axis of the chute.

3. The moving distribution furnace chute according to claim 1, wherein the breadth of at least some of the vanes extends radially inwards to the axis of the chute.

4. The moving distribution furnace chute according to claim 1, wherein at least some of the vanes extend along a full axial length of the chute.

5. The moving distribution furnace chute according to claim 1, wherein the vanes are shorter than the full axial length of the chute.

6. The moving distribution furnace chute according to claim 1, wherein at least one of the vanes is arranged at an angle to the axis of the chute.

7. The moving distribution furnace chute according to claim 1, wherein at least one vane is formed into a spiral in the chute.

8. The moving distribution furnace chute according to claim 1, wherein the vanes are moveable.

9. The moving distribution furnace chute according to claim 1, wherein the vanes are fixed.

10. A furnace assembly comprising:

a furnace, and a moving distribution furnace chute, and a rotation device configured to rotate the chute in a direction of rotation, wherein the chute comprises a tube for distribution of material, the tube having a longitudinal axis, an open inlet end and an open outlet end, and a plurality of vanes mounted on an inner surface of the tube, wherein at least one of the vanes has (a) a length extending in a direction having a first component along the longitudinal axis and a second component along a circumferential direction such that the vane forms a spiral shape in the chute and (b) a breadth extending in a direction having a component radially inwards towards the axis, wherein the circumferential direction is opposite the direction of rotation such that the spiral shape counteracts the rotation of the chute by the rotation device to increase linearity of material flow through the chute, and wherein the open inlet end has a larger diameter than the open outlet end.

11. The furnace assembly according to claim 10, wherein the length of at least some of the vanes is substantially parallel to the axis of the chute.

12. The furnace assembly according to claim 10, wherein the breadth of at least some of the vanes extends radially inwards to the axis of the chute.

13. The furnace assembly according to claim 10, wherein at least some of the vanes extend along a full axial length of the chute.

14. The furnace assembly according to claim 10, wherein the vanes are shorter than the full axial length of the chute.

15. The furnace assembly according to claim 10, wherein the vanes are moveable.

16. The furnace assembly according to claim 10, wherein the vanes are fixed.

17. A method for using a moving distribution furnace chute with a furnace, the method comprising:

rotatably mounting a chute to a flow gate assembly of a furnace, wherein the chute comprises a tube for distribution of material, the tube having a longitudinal axis, an open inlet end and an open outlet end downstream of the open inlet end, wherein the tube further comprises a plurality of vanes mounted on an inner surface of the tube, the vanes having a length extending in a direction having a component along the axis and a breadth extending in a direction having a component radially inwards towards the axis, wherein the open inlet end has a larger diameter than the open outlet end, and wherein the tube comprises three segments having different degrees of taper with respect to the longitudinal axis, the three segments comprising, in order along the longitudinal axis: a first segment, a second segment downstream of the first segment and having a greater degree of taper than the first segment, and a third segment downstream of the second segment having a greater degree of taper than the second segment.

18. The method according to claim 17, wherein the length of at least some of the vanes is substantially parallel to the axis of the chute.

19. The moving distribution furnace chute according to claim 1, wherein the tube comprises a one-piece conical tube.

20. The moving distribution furnace chute according to claim 1, wherein the tube comprises plurality of segments of varying diameter.

21. The furnace assembly according to claim 10, wherein the tube comprises a one-piece conical tube.

22. The furnace assembly according to claim 10, wherein the tube comprises plurality of segments of varying diameter.

23. The method according to claim 17, wherein the tube comprises a one-piece conical tube.

24. The method according to claim 17, wherein the tube comprises plurality of segments of varying diameter.

25. The moving distribution furnace chute according to claim 1, wherein the breadth of each vane extending in the direction radially inwards towards the longitudinal axis decreases along the vane in a direction from the inlet end toward the outlet end of the chute.

26. The moving distribution furnace chute according to claim 1, wherein the first segment is cylindrical, and the second and third segments are frustoconical.

27. The moving distribution furnace chute according to claim 1, wherein the vanes extend along each of the three segments of the tube.

* * * * *